US006991568B1

(12) United States Patent
Tien

(10) Patent No.: US 6,991,568 B1
(45) Date of Patent: Jan. 31, 2006

(54) HEIGHT ADJUSTABLE BASKETBALL FRAME STRUCTURE

(75) Inventor: Feng-Yi Tien, Jia Yi (TW)

(73) Assignee: Acas Design Co., Ltd., Jia Yi (TW)

( * ) Notice: Subject to any disclaimer, the term of this patent is extended or adjusted under 35 U.S.C. 154(b) by 0 days.

(21) Appl. No.: 10/888,057

(22) Filed: Jul. 9, 2004

(51) Int. Cl.
*A63B 63/08* (2006.01)

(52) U.S. Cl. ..... 473/484; 473/481; 267/140

(58) Field of Classification Search ..... 473/479–484; 403/97; 267/140
See application file for complete search history.

(56) References Cited

U.S. PATENT DOCUMENTS 2,144,148 A * 1/1939 Gross ..... 473/481
2,227,310 A * 12/1940 Hoppes et al. ..... 473/481
2,818,254 A * 12/1957 Dunn ..... 473/481
2,838,308 A * 6/1958 Polite ..... 473/488
3,427,025 A * 2/1969 Procter ..... 473/483
4,869,501 A * 9/1989 Anastasakis ..... 473/483
5,300,920 A * 4/1994 Caselli et al. ..... 473/480
5,919,102 A * 7/1999 Smith et al. ..... 473/484

* cited by examiner

*Primary Examiner*—Gregory Vidovich
*Assistant Examiner*—M. Chambers
(74) *Attorney, Agent, or Firm*—Alan D. Kamrath; Nikolai & Mersereau, P.A.

(57) ABSTRACT

A basketball frame structure includes a backboard, two fixing plates, a base, two first upright rods, two second upright rods, two first links, an adjusting bar, two second links, and a plurality of hollow weights. Thus, the height of the backboard is changed by movement of the adjusting bar, thereby facilitating a user adjusting the height of the backboard. In addition, when the adjusting bar is moved, the positioning bolt is slidable in the slideway of the adjusting bar and detachably locked in either one of the retaining slots of the adjusting bar, so that the height of the backboard is changed in a multi-stage manner so as to fit requirements of different users.

15 Claims, 7 Drawing Sheets

HEIGHT ADJUSTABLE BASKETBALL FRAME STRUCTURE

BACKGROUND OF THE INVENTION

1. Field of the Invention

The present invention relates to a basketball frame structure, and more particularly to a height adjustable basketball frame structure.

2. Description of the Related Art

A conventional basketball frame structure comprises a padded base, a column mounted on the padded base, a support unit mounted on the column, a brace member mounted on the support unit, and a backboard mounted on the brace member. However, the backboard has a fixed height that cannot be adjusted to fit requirements of users of different ages and heights, thereby decreasing the versatility of the conventional basketball frame structure.

SUMMARY OF THE INVENTION

In accordance with the present invention, there is provided a basketball frame structure, comprising:

a backboard;

two fixing plates each mounted on the backboard;

a base located below the backboard;

two first upright rods each mounted on a first end of the base;

two second upright rods each mounted on a second end of the base;

two first links each having a first end pivotally mounted on an upper end of a respective one of the two first upright rods and a second end pivotally mounted on a first end of a respective one of the two fixing plates;

an adjusting bar having a first end movably mounted between the two second upright rods; and two second links each having a first end pivotally mounted on a second end of the adjusting bar, a mediate portion pivotally mounted on a respective one of the two first upright rods and a second end pivotally mounted on a second end of a respective one of the two fixing plates.

The primary objective of the present invention is to provide a height adjustable basketball frame structure.

Another objective of the present invention is to provide a basketball frame structure, wherein the height of the backboard is changed easily and conveniently by movement of the adjusting bar, thereby facilitating a user adjusting the height of the backboard.

A further objective of the present invention is to provide a basketball frame structure, wherein when the adjusting bar is moved, the positioning bolt is slidable in the slideway of the adjusting bar and detachably locked in either one of the retaining slots of the adjusting bar, so that the height of the backboard is changed in a multi-stage manner so as to fit requirements of different users.

A further objective of the present invention is to provide a basketball frame structure, wherein the weights are used to support the basketball frame structure rigidly and stably.

Further benefits and advantages of the present invention will become apparent after a careful reading of the detailed description with appropriate reference to the accompanying drawings.

DETAILED DESCRIPTION OF THE INVENTION

Figure 1:
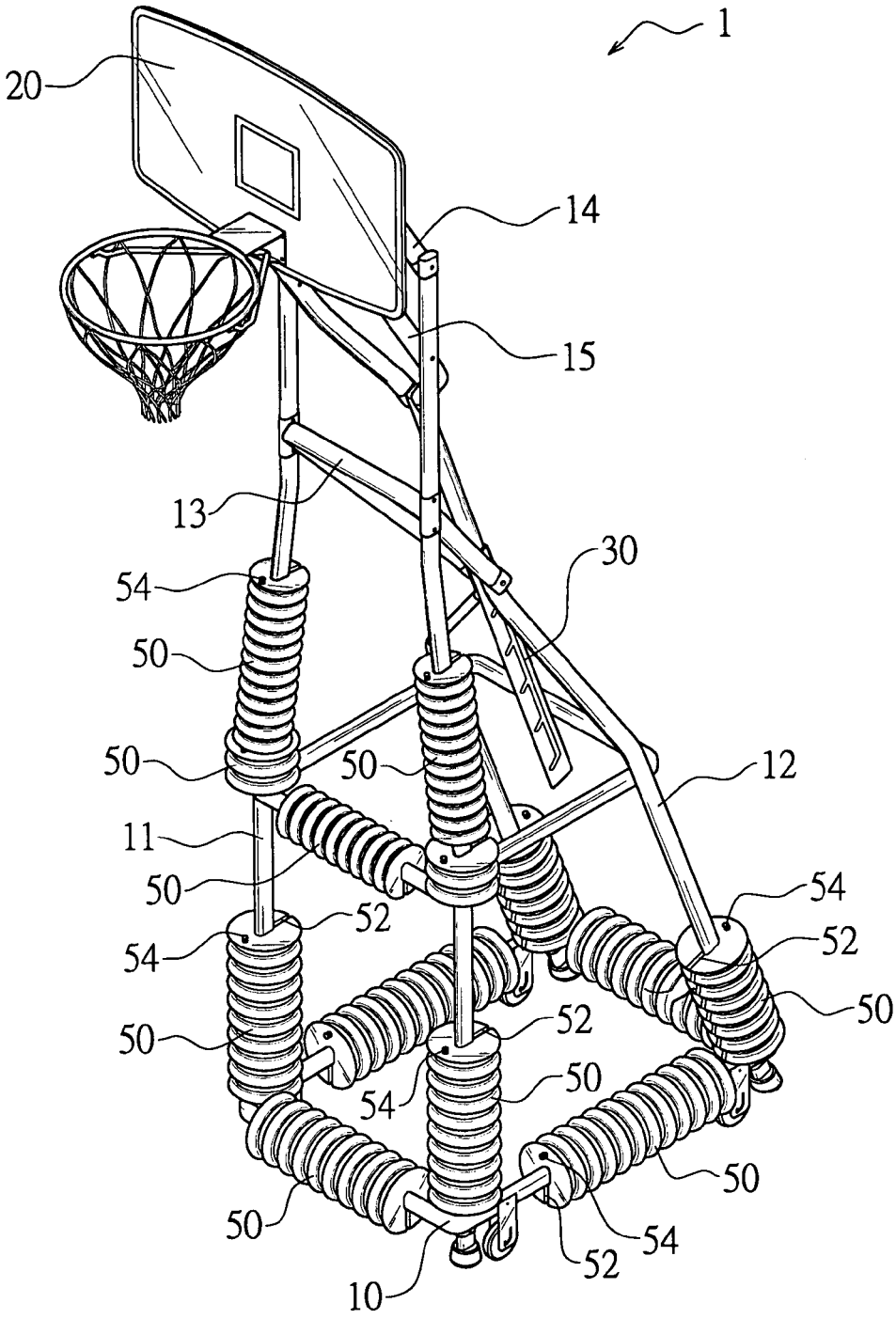
FIG. 1 is a perspective view of a basketball frame structure in accordance with the preferred embodiment of the present invention.
Figure 2:
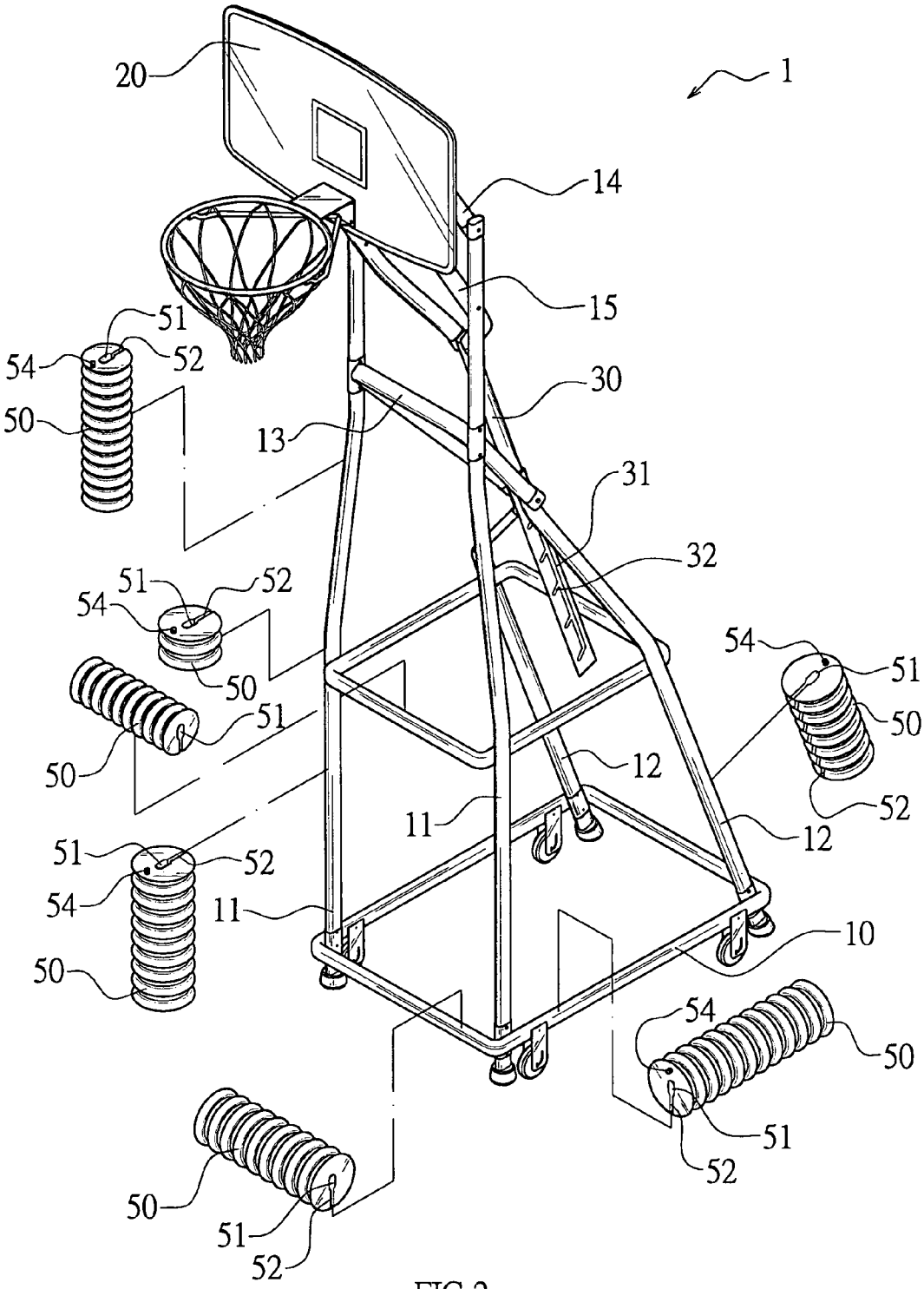
FIG. 2 is a partially exploded perspective view of the basketball frame structure as shown in FIG. 1.
Figures 3, 4:
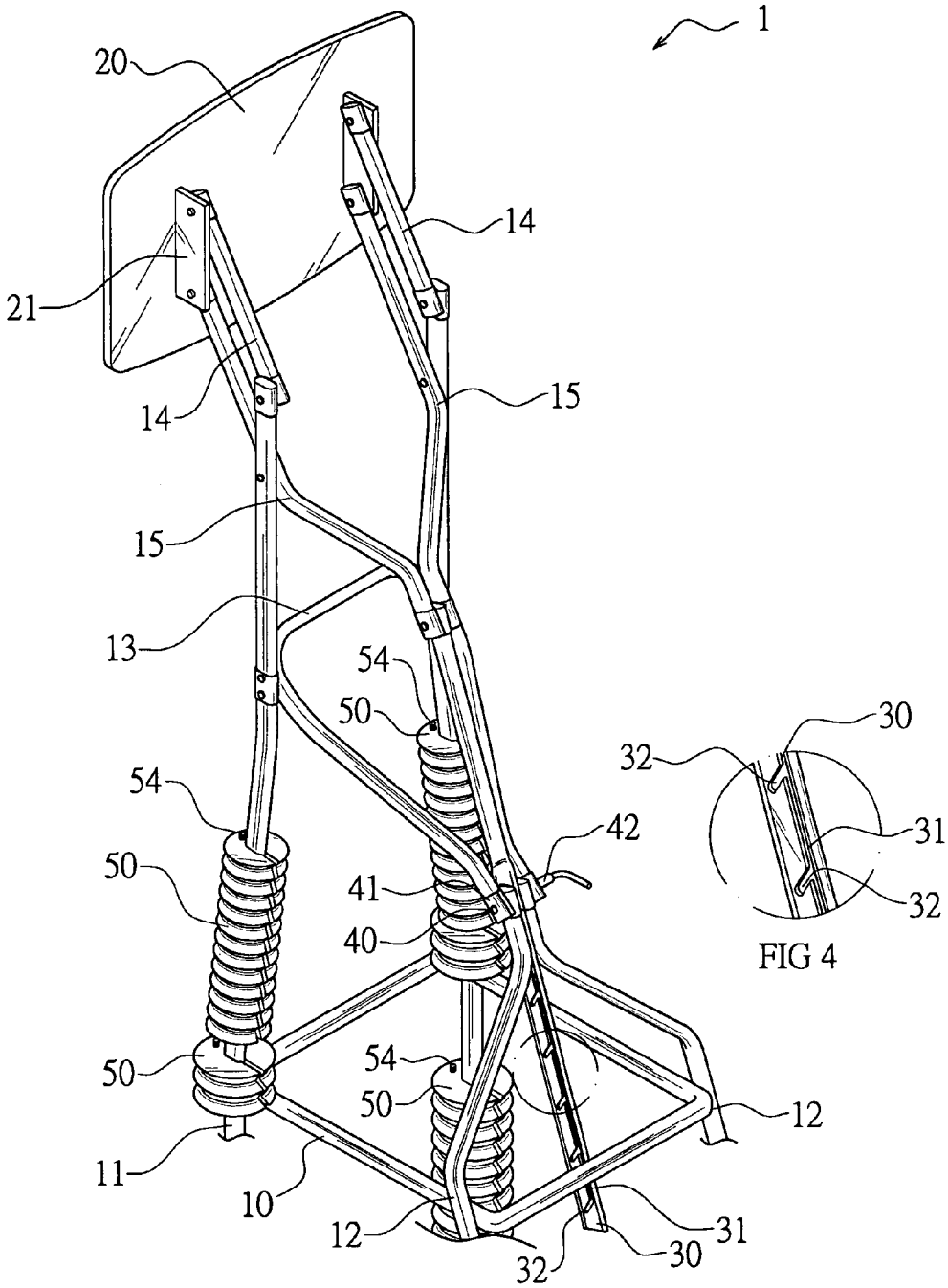
FIG. 3 is a perspective view of the basketball frame structure as shown in FIG. 1.
FIG. 4 is a partially perspective enlarged view of the basketball frame structure as shown in FIG. 3.

Referring to the drawings and initially to FIGS. 1–6, a height adjustable basketball frame structure 10 in accordance with the preferred embodiment of the present invention comprises a backboard 20, two fixing plates 21 each mounted on the backboard 20, a base 10 located below the backboard 20, two first upright rods 11 each mounted on a first end of the base 10, two second upright rods 12 each mounted on a second end of the base 10, two first links 14 each having a first end pivotally mounted on an upper end of a respective one of the two first upright rods 11 and a second end pivotally mounted on a first end of a respective one of the two fixing plates 21, an adjusting bar 30 having a first end movably mounted between the two second upright rods 12, and two second links 15 each having a first end pivotally mounted on a second end of the adjusting bar 30, a mediate portion pivotally mounted on a respective one of the two first upright rods 11 and a second end pivotally mounted on a second end of a respective one of the two fixing plates 21.

A reinforcing bar 13 is mounted between the two first upright rods 11 and the two second upright rods 12. The first end of the adjusting bar 30 is formed with a longitudinally arranged slideway 31 having a wall formed with a plurality of transversely arranged oblique retaining slots 32.

Figure 5:
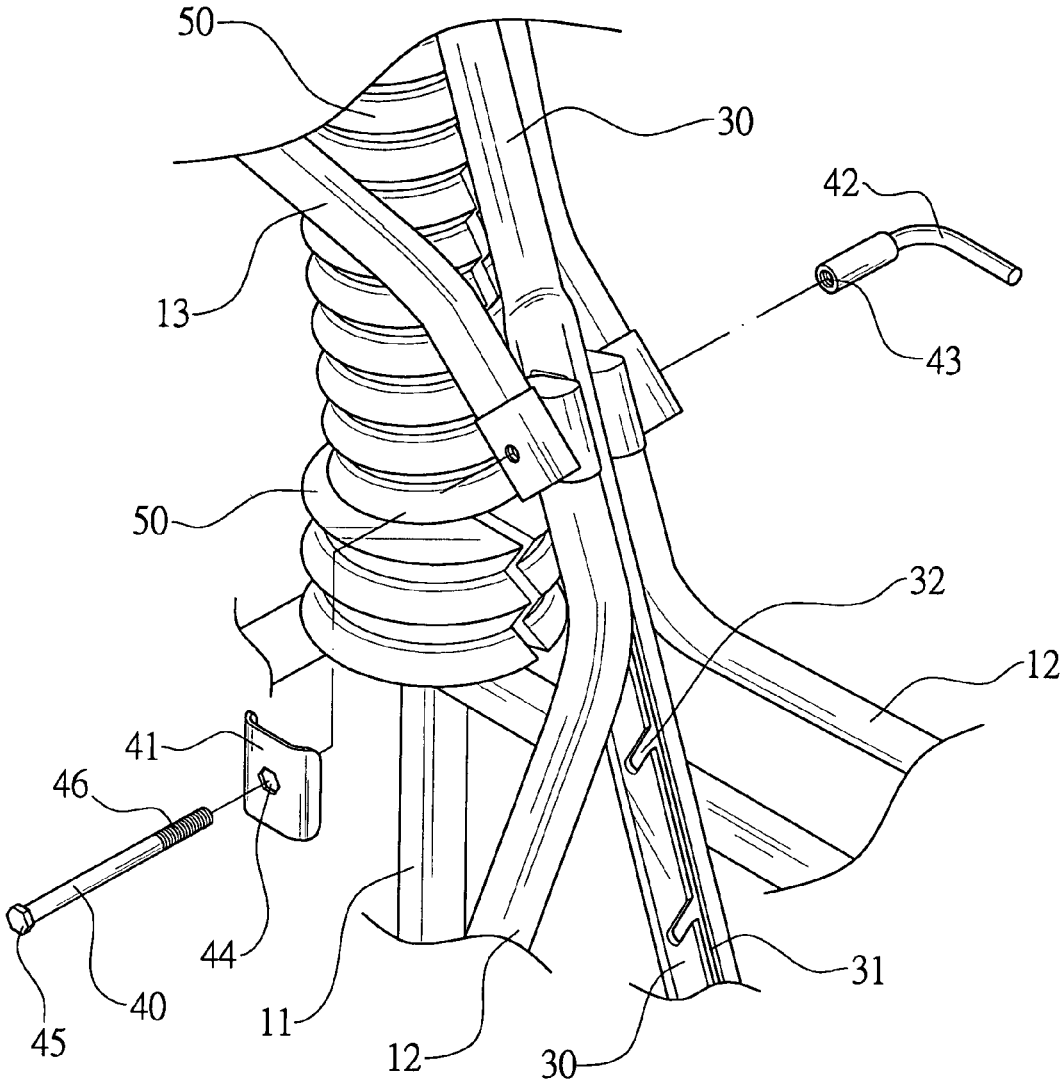
FIG. 5 is a partially exploded perspective enlarged view of the basketball frame structure as shown in FIG. 3.

As shown in FIG. 5, the basketball frame structure 10 further comprises a fixing plate 41 fixed on the reinforcing bar 13, a positioning bolt 40 extended through the fixing plate 41, the reinforcing bar 13, the slideway 31 of the adjusting bar 30 and the two second upright rods 12 and detachably locked in either one of the retaining slots 32 of the adjusting bar 30, and a control handle 42 fixed on the positioning bolt 40 and urged on the two second upright rods 12 to position the adjusting bar 30 between the two second upright rods 12.

The fixing plate 41 is formed with a hexagonal hole 44, and the positioning bolt 40 has a first end formed with a hexagonal head 45 secured in the hexagonal hole 44 of the fixing plate 41. The positioning bolt 40 has a second end formed with an outer thread 46, and the control handle 42 has an end formed with a screw bore 43 screwed onto the outer thread 46 of the positioning bolt 40.

When the control handle 42 is unscrewed from the positioning bolt 40, the adjusting bar 30 is movable between the two second upright rods 12, and the positioning bolt 40 is slidable in the slideway 31 of the adjusting bar 30 and detachably locked in either one of the retaining slots 32 of the adjusting bar 30.

Figure 7:
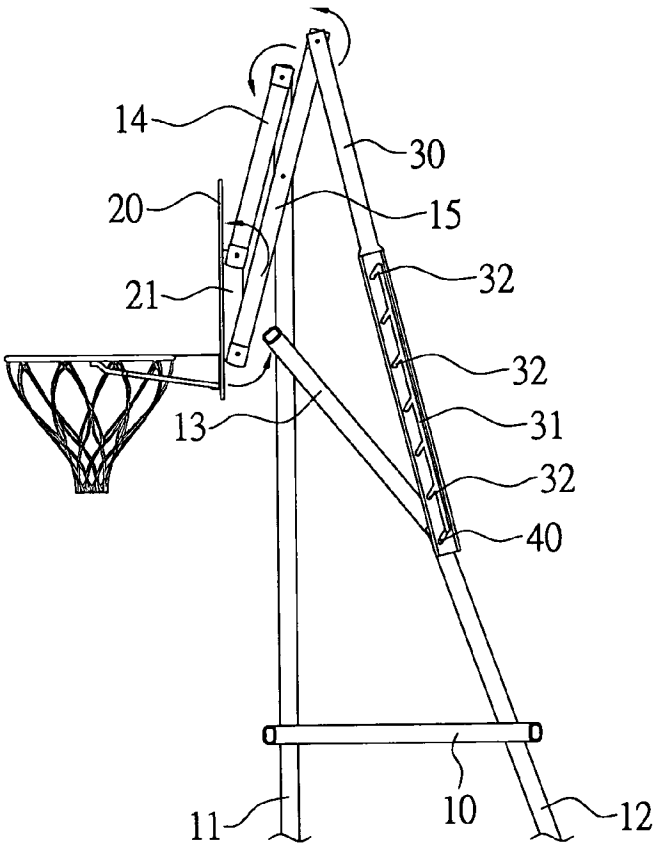
FIG. 7 is a schematic operational view of the basketball frame structure as shown in FIG. 6.
Figure 6:
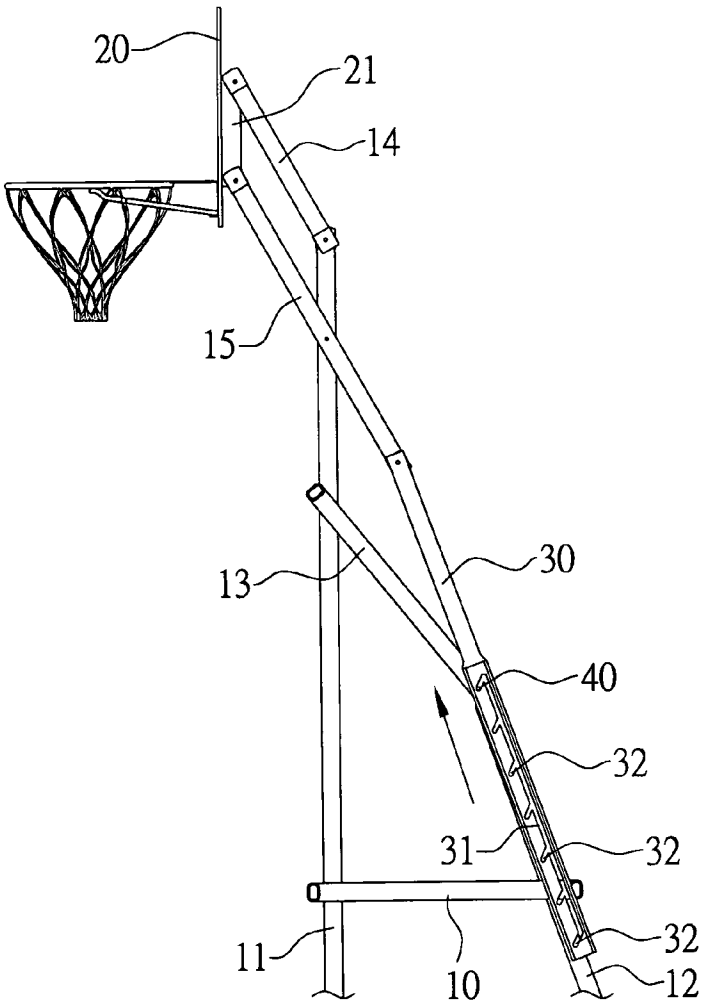
FIG. 6 is a side plan view of the basketball frame structure as shown in FIG. 3.

In operation, referring to FIGS. 6 and 7 with reference to FIGS. 1–5, when the control handle 42 is unscrewed from the positioning bolt 40, the adjusting bar 30 is movable relative to the two second upright rods 12 to drive the two second links 15 and the two first links 14 to move from the position as shown in FIG. 6 to the position as shown in FIG. 7 so as to change the position of the backboard 20, so that the height of the backboard 20 is changed easily and conveniently by movement of the adjusting bar 30, thereby facilitating a user adjusting the height of the backboard 20. In addition, when the adjusting bar 30 is moved, the positioning bolt 40 is slidable in the slideway 31 of the adjusting bar 30 and detachably locked in either one of the retaining slots 32 of the adjusting bar 30, so that the height of the backboard 20 is changed in a multi-stage manner so as to fit requirements of different users.

Figure 9:
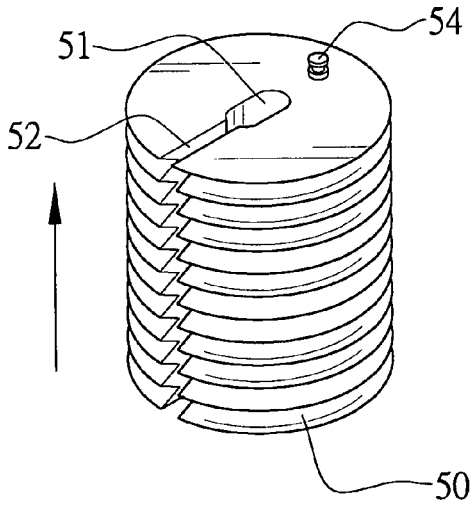
FIG. 9 is a perspective assembly view of the weight of the basketball frame structure as shown in FIG. 8.
Figure 8:
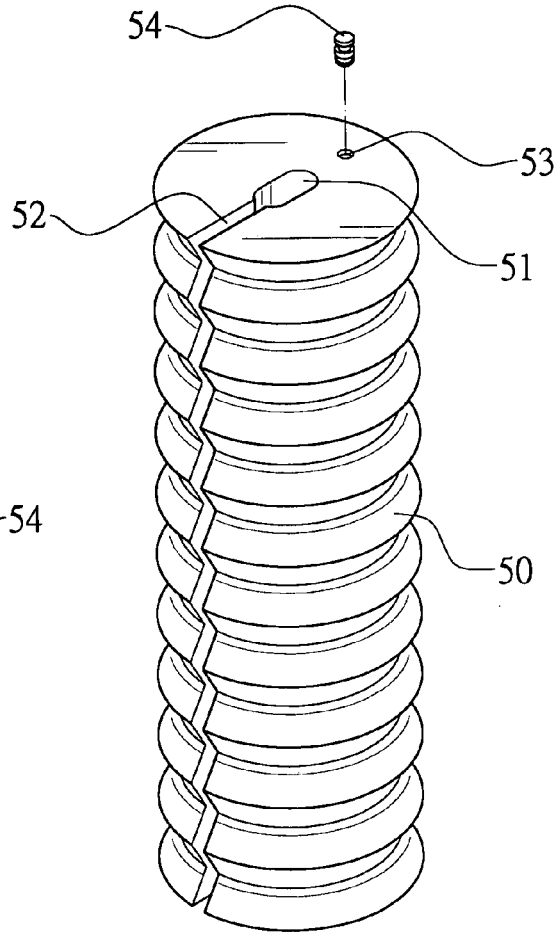
FIG. 8 is a perspective view of a weight of the basketball frame structure in accordance with the preferred embodiment of the present invention.

Referring to FIGS. 8 and 9 with reference to FIG. 1, the basketball frame structure 10 further comprises a plurality of hollow weights 50 mounted on the base 10, the first upright rods 11 and the second upright rods 12 to support the basketball frame structure 10 rigidly and stably. Each of the weights 50 is inflatable and expandable and has a corrugated shape. Each of the weights 50 has a central portion formed with a mounting hole 51 mounted on the base 10, the first upright rods 11 and the second upright rods 12 and has a periphery formed with a slit 52 communicating with the mounting hole 51 to facilitate each of the weights 50 being mounted on the base 10, the first upright rods 11 and the second upright rods 12. Each of the weights 50 has an end formed with a filling port 53 for filling sand, water or the like into the inside of each of the weights 50 so as to inflate each of the weights 50. A plug 54 is removably inserted into the filling port 53 of each of the weights 50.

Figure 10:
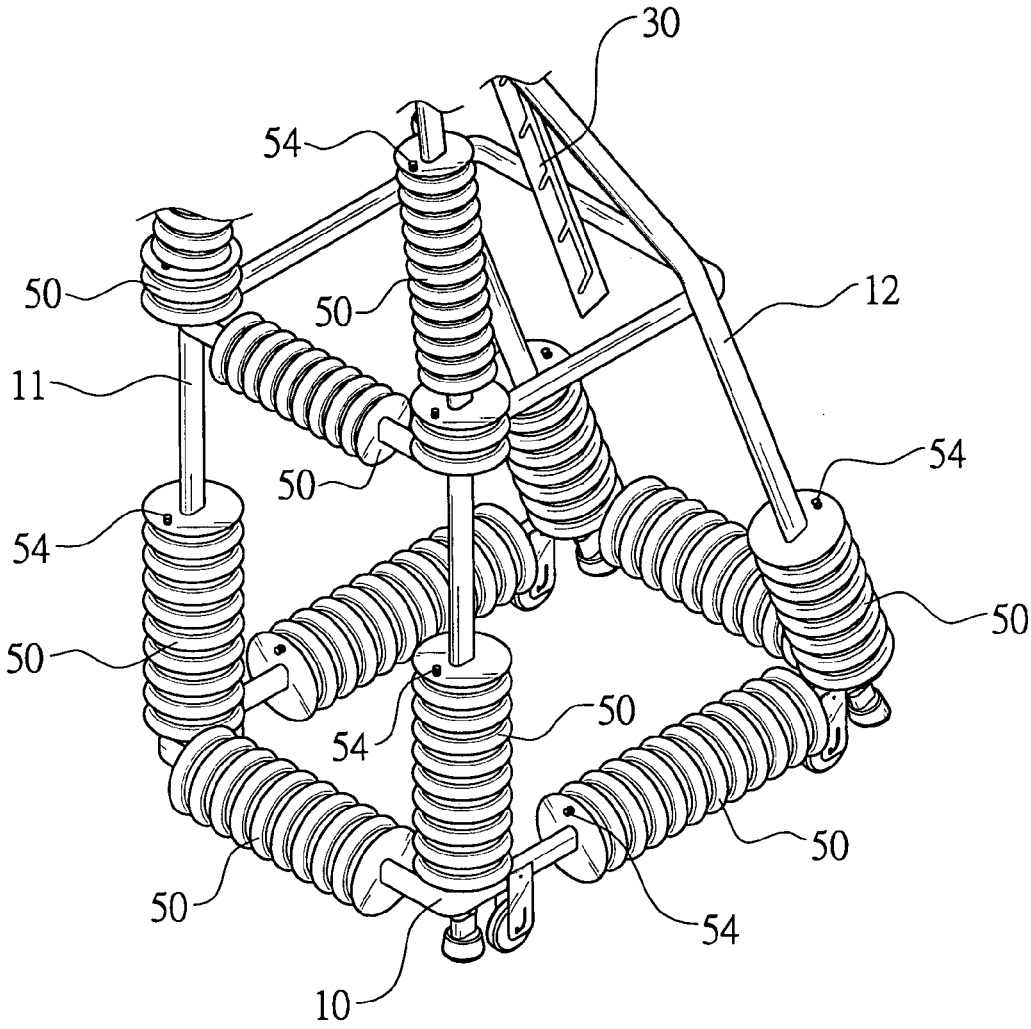
FIG. 10 is a partially cut-away perspective view of a basketball frame structure in accordance with another embodiment of the present invention.

Referring to FIG. 10, the slit 52 is undefined, and each of the weights 50 is integrally formed on the base 10, the first upright rods 11 and the second upright rods 12 during the manufacturing process.

Accordingly, the height of the backboard 20 is changed easily and conveniently by movement of the adjusting bar 30, thereby facilitating a user adjusting the height of the backboard 20. In addition, when the adjusting bar 30 is moved, the positioning bolt 40 is slidable in the slideway 31 of the adjusting bar 30 and detachably locked in either one of the retaining slots 32 of the adjusting bar 30, so that the height of the backboard 20 is changed in a multi-stage manner so as to fit requirements of different users. Further, the weights 50 are used to support the basketball frame structure 10 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A basketball frame structure, comprising:

a backboard;

two fixing plates each mounted on the backboard;

a base located below the backboard;

two first upright rods each mounted on a first end of the base;

two second upright rods each mounted on a second end of the base;

two first links each having a first end pivotally mounted on an upper end of a respective one of the two first upright rods and a second end pivotally mounted on a first end of a respective one of the two fixing plates;

an adjusting bar having a first end movably mounted between the two second upright rods; and two second links each having a first end pivotally mounted on a second end of the adjusting bar, a mediate portion pivotally mounted on a respective one of the two first upright rods and a second end pivotally mounted on a second end of a respective one of the two fixing plates.

2. The basketball frame structure in accordance with claim 1, wherein the first end of the adjusting bar is formed with a longitudinally arranged slideway having a wall formed with a plurality of transversely arranged oblique retaining slots, and the basketball frame structure further comprises a positioning bolt extended through the slideway of the adjusting bar and the two second upright rods and detachably locked in either one of the retaining slots of the adjusting bar.

3. The basketball frame structure in accordance with claim 2, further comprising a reinforcing bar mounted between the two first upright rods and the two second upright rods, wherein the positioning bolt is extended through the reinforcing bar.

4. The basketball frame structure in accordance with claim 3, further comprising a fixing plate fixed on the reinforcing bar, wherein the positioning bolt is extended through the fixing plate.

5. The basketball frame structure in accordance with claim 4, wherein the fixing plate is formed with a hexagonal hole, and the positioning bolt has a first end formed with a hexagonal head secured in the hexagonal hole of the fixing plate.

6. The basketball frame structure in accordance with claim 2, further comprising a control handle fixed on the positioning bolt and urged on the two second upright rods to position the adjusting bar between the two second upright rods.

7. The basketball frame structure in accordance with claim 6, wherein the positioning bolt has a second end formed with an outer thread, and the control handle has an end formed with a screw bore screwed onto the outer thread of the positioning bolt.

8. The basketball frame structure in accordance with claim 6, wherein the when the control handle is unscrewed from the positioning bolt, the adjusting bar is movable between the two second upright rods, and the positioning bolt is slidable in the slideway of the adjusting bar and detachably locked in either one of the retaining slots of the adjusting bar.

9. The basketball frame structure in accordance with claim 1, further comprising a plurality of hollow weights mounted on the base, the first upright rods and the second upright rods.

10. The basketball frame structure in accordance with claim 9, wherein each of the weights is inflatable and expandable.

11. The basketball frame structure in accordance with claim 9, wherein each of the weights has a corrugated shape.

12. The basketball frame structure in accordance with claim 9, wherein each of the weights has a central portion formed with a mounting hole mounted on the base, the first upright rods and the second upright rods.

13. The basketball frame structure in accordance with claim 12, wherein each of the weights has a periphery formed with a slit communicating with the mounting hole.

14. The basketball frame structure in accordance with claim 9, wherein each of the weights has an end formed with a filling port.

15. The basketball frame structure in accordance with claim 9, further comprising a plug removably inserted into the filling port of each of the weights.

* * * * *